US006857842B2

(12) United States Patent
Heiple

(10) Patent No.: US 6,857,842 B2
(45) Date of Patent: Feb. 22, 2005

(54) ADAPTER ASSEMBLY FOR AN IMPLEMENT COUPLING SYSTEM

(75) Inventor: Ashley Heiple, Alum Bank, PA (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 10/053,327

(22) Filed: Jan. 17, 2002

(65) Prior Publication Data

US 2003/0133779 A1 Jul. 17, 2003

(51) Int. Cl.[7] ..... E02F 3/96
(52) U.S. Cl. ..... 414/723; 37/468
(58) Field of Search ..... 414/723; 37/468; 403/3, 176; 172/272–275

(56) References Cited

U.S. PATENT DOCUMENTS 4,116,346 A * 9/1978 Uchida ..... 414/723
4,133,121 A * 1/1979 Hemphill ..... 414/723 X
4,813,163 A * 3/1989 Livingston et al. ..... 414/723 X
4,836,741 A * 6/1989 Louis et al. ..... 414/723
6,422,805 B1 * 7/2002 Miller ..... 414/723
6,487,800 B1 * 12/2002 Evans et al. ..... 414/723 X

* cited by examiner

*Primary Examiner*—Donald W. Underwood
(74) *Attorney, Agent, or Firm*—Stevens, Davis, Miller & Mosher, LLP

(57) ABSTRACT

In an assembly mountable on a machine, including an implement provided with a pair of mounting brackets each having a pair of opposed pin receiving recesses, a dipper stick operatively connected to the machine for selected movement and having a first connecting pin rotatably mounted in an end thereof and receivable in one of the implement recesses, a fluid actuated cylinder assembly having a cylinder member pivotally connectable to the dipper stick and a rod member provided with an operatively connected second connecting pin rotatable relative thereto and receivable in the other of the implement recesses, and a pair of spacer links each disposed on a side of the dipper stick and spaced therefrom, operable to selectively maintain the connecting pins in retracted, inoperative positions permitting them to be maneuvered and inserted into or removed from the implement recesses, and in extended, inoperative positions within the implement recesses, detachably coupling the implement to the dipper stick, an adapter assembly generally consisting of at least one pair of bushings each mountable on one of the connecting pins between one of the dipper stick and the operative connection of one of the connecting pins to the rod member, and one of the spacer links, having a cross-sectional configuration receivable within one of the implement recesses.

22 Claims, 3 Drawing Sheets

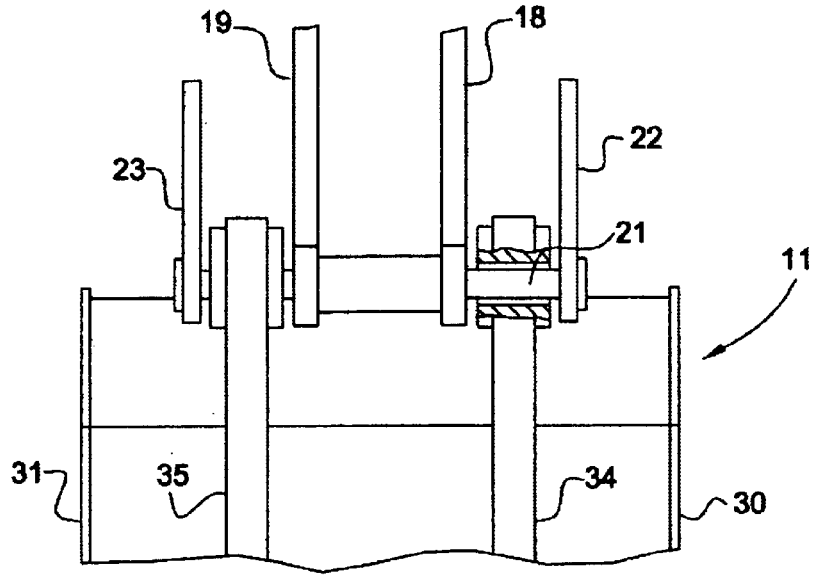
FIG. 5
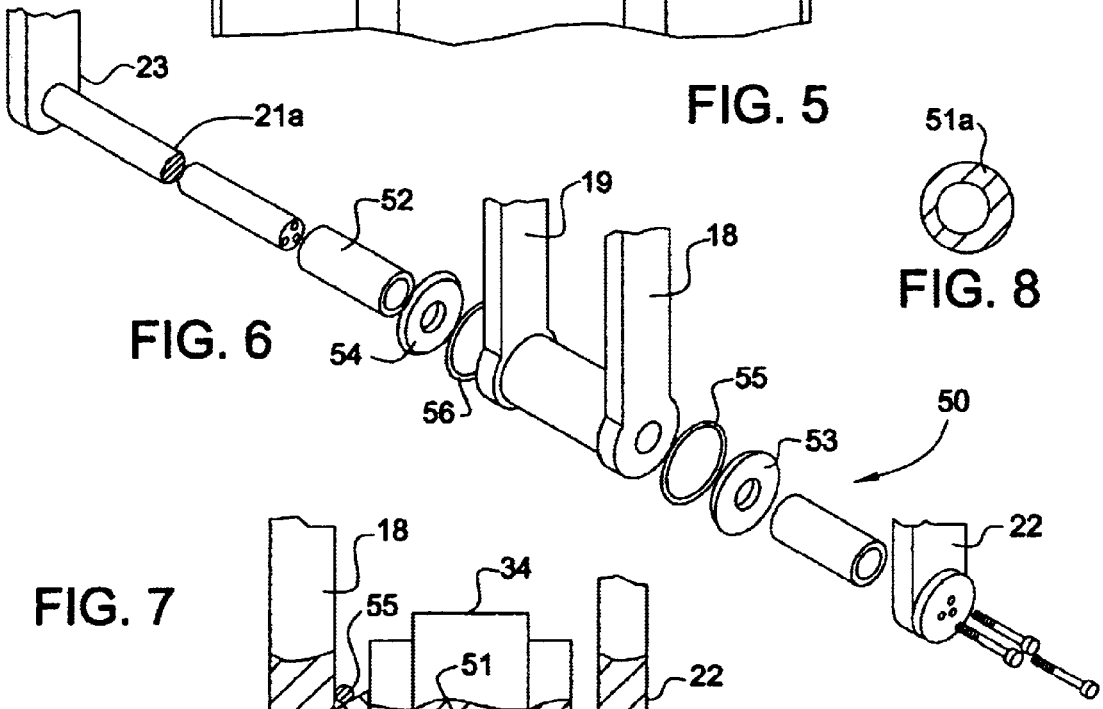
FIG. 6
FIG. 8
FIG. 7
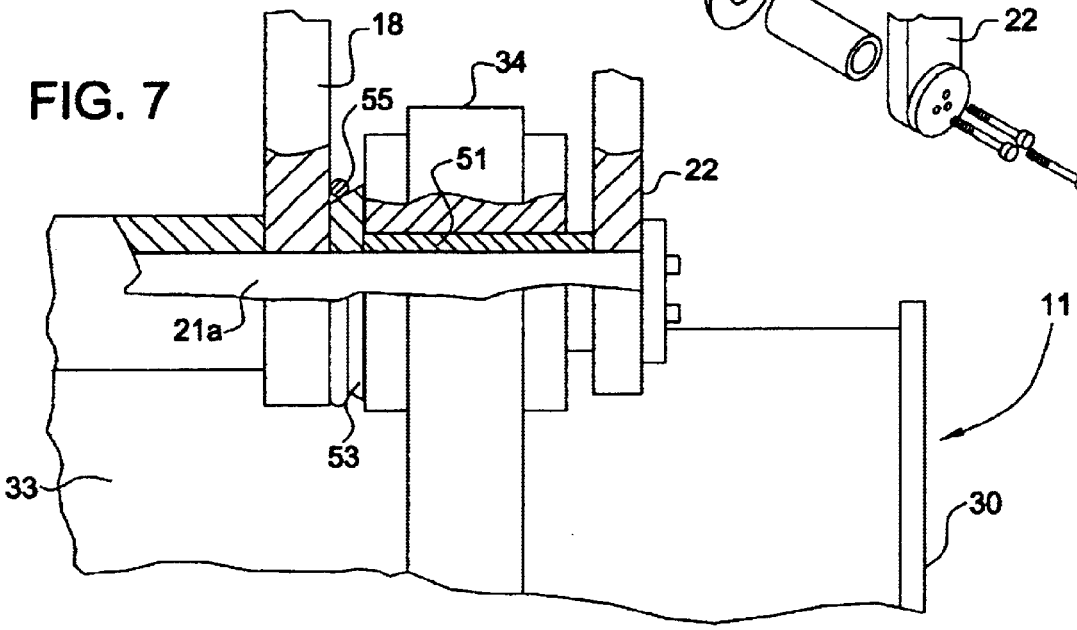

ADAPTER ASSEMBLY FOR AN IMPLEMENT COUPLING SYSTEM

This invention relates to assemblies for detachably coupling implements such as buckets, grapples, crushers, splitters, rakes and the like to the handle or dipper stick of an excavating machine and the like, and more particularly to an assembly for adapting such coupling assemblies to handles or dipper sticks and implements of different sizes and configurations.

BACKGROUND OF THE INVENTION

Conventional excavating machines typically are provided with a handle or dipper stick pivotally connected to a boom which may be lifted and lowered, means for pivotally connecting an implement to the free end of the dipper stick, a pair of support links pivotally connected to the dipper stick and having a connecting pin provided on the free ends thereof, a pair of actuating links pivotally connected at one pair of ends to the connecting pin provided on the support links and connectable at the other set of ends thereof to an implement, and a fluid actuated cylinder assembly pivotally connected at one end thereof to the underside of the dipper stick and connected at the other end thereof to the connecting pin of the support links, which may be extended and retracted in the conventional manner to pivot or curl and uncurl an implement pivotally connected at one point to the dipper stick and pivotally connected at another point to the actuating links.

In the use of such assemblies, it often is desirable to mount different implements to perform different work functions. To facilitate the use of such different implements, various assemblies have been developed for detachably coupling different implements to the dipper sticks of such machines. An example of one of such assemblies for detachably coupling a number of different implements to the dipper stick of a machine is illustrated and described in U.S. patent application Ser. No. 09/880,303, filed on Jun. 13, 2001. In such coupling assembly, there is provided a first connecting pin pivotally mounted on the free end of the dipper stick and connectable to a pair of mounting brackets on an implement, a second connecting pin mounted in the free ends of the actuating links and connectable to the mounting brackets of the implement, a pair of spacer links connected at one set of ends to one of such connecting pins and engageable at the other set of ends thereof to the other connecting pin to form a four bar linkage and means for detachably securing the free ends of the spacer links to such other connecting pin. In a comparable arrangement of such a coupling assembly, in lieu of a rigid spacer link, there is provided a pair of link segments pivotally connected at one set of ends thereof, rigidly connected at the other ends thereof to the connecting pins mounted in the dipper stick and actuating links, which are adapted to pivot together to a collapsed, inoperative condition and pivot apart to an extended, operative position, and means for detachably securing such link segments in their extended, operative conditions.

Although the coupling assemblies as described have been highly effective in detachably connecting various implements to the dipper sticks of such machines, it has been found that the sizes, dimensions and configurations of dipper sticks, the connecting pins of such dipper sticks and mounting brackets of implements vary which thus precludes the use of a single, standard configuration of such a coupling assembly. It thus has been found to be desirable and correspondingly the principal object of this invention to provide an assembly for adapting such coupler assemblies for use with dipper sticks, connecting pins and implement mounting brackets of different sizes, dimensions and configurations.

SUMMARY OF THE INVENTION

The present invention generally provides for a set of bushings generally having a cylindrical shank section, an annular head section and an axial bore therethrough which are mountable on the ends of a connecting pin. The length of each of such bushings may be varied to accommodate dipper sticks of different thicknesses, the diameter of the bore may vary to accommodate connecting pins of different diameters and the outside diameter of the cylindrical shank section may vary to accommodate connecting pin receiving recesses in the mounting brackets of the implements having different radii of curvature. The invention further contemplates utilizing bushings with shank sections having outer cylindrical surfaces disposed eccentrically relative to the cylindrical bores therein to permit the bushings to be rotated about the axes of the connecting pins to vary the distances between the shank sections of such pins to accommodate different spacing between connecting pin receiving recesses in the mounting brackets of the implements.

BRIEF DESCRIPTION OF THE DRAWINGS

FIG. 5 is rear, elevational view of the bucket shown in FIG. 1 detachably coupled to the actuating links connected to the dipper stick shown in FIG. 1;

FIG. 6 is a perspective view of the connecting pin shown in FIG. 5, provided with another embodiment of the present invention shown in exploded relation and having portions thereof broken away;

FIG. 7 is a rear, elevational view of the bucket shown in FIG. 5, detachably coupled to the actuating links shown in FIG. 5, utilizing a bushing as shown in FIG. 6, embodying the present invention, having portions thereof broken away; and FIG. 8 is a vertical cross sectional view of a bushing comparable to the bushing shown in FIGS. 6 and 7, comprising another embodiment of the present invention.

DETAILED DESCRIPTION OF THE PREFERRED EMBODIMENTS OF THE INVENTION

Figure 1:
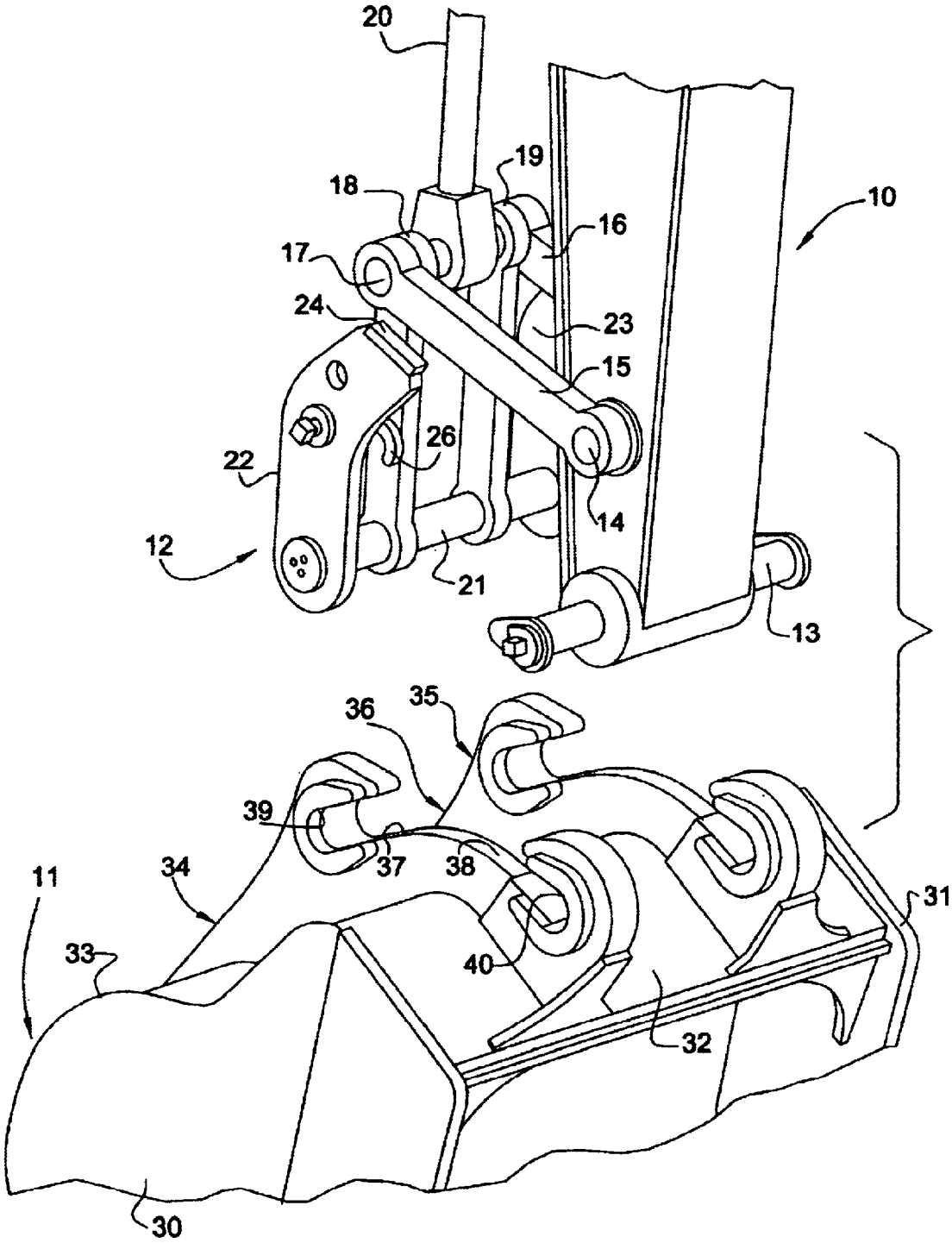
FIG. 1 is a perspective view of a dipper stick, an implement connectable to the dipper stick and an assembly for detachably connecting the implement to the dipper stick, illustrating the implement detached from the dipper stick and the coupling assembly in the uncoupled condition, and having portions thereof broken away.
Figure 2:
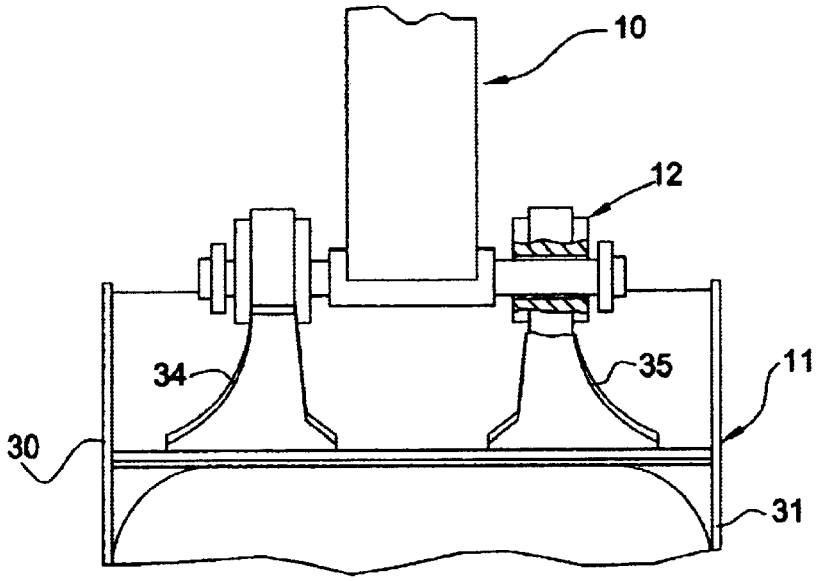
FIG. 2 is a front elevational view of the bucket shown in FIG. 2 detachably coupled to the dipper stick shown in FIG. 1, having portions thereof broken away.

Referring to FIGS. 1, 2 and 5 of the drawings, there is illustrated a dipper stick 10 of an excavating machine, an excavating bucket 11 and an assembly 12 for coupling the bucket to the free end of the dipper stick in the conventional manner. Dipper stick 10 is of a conventional construction and is pivotally connected at an upper end thereof to a boom, and is pivotal relative to such boom by means of a fluid actuated cylinder assembly. Rotatably mounted on the free end of dipper stick 10 is a first connecting pin 13 having a transversely disposed axis. Spaced from pin 13 is a mounting pin 14 having a transverse axis, on which a pair of support links 15 and 16 are mounted for pivotal movement in parallel planes, relative to the dipper stick. The free ends of the support links are pivotally connected to a connecting pin 17 on which there also are connected the upper ends of a pair of actuating links 18 and 19. Operatively interconnecting the underside of dipper stick 10 and connecting pin 17 is a fluid actuated cylinder assembly including a cylinder member having the base end thereof pivotally connected to a set of brackets mounted on the underside of the dipper stick, and a rod member 20 pivotally connected at its free end to connecting pin 17.

Rotatably mounted on the lower ends of actuating links 18 and 19 is a connecting pin 21 having a transverse axis disposed parallel to the axes of connecting pins 13, 14 and 17. A set of spacer links 22 and 23 are rigidly secured to the ends of connecting pin 21 and extend substantially radially relative thereto. The free ends of the spacer links are provided with a pair of abutment surfaces 24 (only one of which is shown) which are adapted to engage the outer ends of connecting pin 13 when such links are rotated in a clockwise direction relative to FIG. 1 about the axis of connecting pin 21. When the abutment surfaces of links 22 and 23 engage connecting pin 13, such links may be secured in such positions by means of a pair of latch mechanisms 26 (only one of which is shown).

With abutment surfaces 24 and 25 engaging the outer ends of connecting pin 13 and the free ends thereof latched to the ends of the connecting pin, the spacer links cooperate with a portion of the dipper stick disposed between connecting pin 13 and mounting pin 14, support links 15 and 16 and actuating links 18 and 19 to form a pair of laterally spaced, four bar linkages. With such linkages thus intact, the cylinder assembly operatively interconnecting the underside of the dipper stick and connecting pin 17 may be operated to pivot spacer links 22 and 23 about the axis of connecting pin 13. When the spacer links are unlatched, operation of the cylinder assembly between the dipper stick and connecting pin 17 will cause the support links 15 and 16 to pivot about the axis of mounting pin 14 and thus allow connecting pins 13 and 21 to displace relative to each other.

Bucket 11 is of a conventional configuration except for the mounting brackets. It is provided with a pair of laterally spaced side walls 30 and 31 and an adjoining wall including an upper section 32, a downwardly and forwardly curved, rear wall section 33 and a forwardly extending bottom wall terminating at a front cutting edge. Rigidly secured to the upper wall section 32 is a pair of identical, laterally spaced mounting brackets 34 and 35. Mounting bracket 34 is recessed at an upper edge thereof as at 36 providing an entry or access and a pair of lower guide surfaces 37 and 38 inclined toward a pair of opposed, pin receiving recesses 39 and 40. The forwardly disposed recesses of mounting brackets 34 and 35 are transversely aligned and are adapted to receive the end portions of connecting pin 13, and the rearwardly disposed recesses of such brackets are transversely aligned and adapted to receive the end portions of connecting pin 21, when the bucket is connected to the dipper stick as shown in FIGS. 2 and 5.

With bucket 11 positioned on the ground and spacer links 22 and 23 unlatched to connecting pin 13, as shown in FIG. 1, the bucket may be coupled to the dipper stick first by manipulating the dipper stick to insert the ends of connecting pin 13 in the forwardly disposed recesses of the mounting brackets on the implement, and then operating the fluid actuated cylinder assembly to insert and thus position the end portions of connecting pin 21 in the rearwardly disposed recesses of the mounting brackets. When connecting pins 13 and 21 are thus positioned in the recesses of mounting brackets 34 and 35, and the forward ends of spacer links 22 and 23 engage the ends of connecting pin 13, the spacer links may be latched to connecting pin 13 to pivotally couple the bucket to the dipper stick.

In maneuvering the dipper stick to position the ends of connecting pin 13 in the forwardly disposed recesses of the mounting brackets, the bottom wall edges of the bracket recesses, inclined toward the forwardly disposed recesses, function to guide the ends of connecting pin 13 into the forwardly disposed recesses of the mounting brackets. Similarly, the surfaces engaged by the outer ends of connecting pin 21, function to guide such pin sections into the rearwardly disposed recesses of the mounting brackets. With the bucket thus coupled, the cylinder assembly interconnecting the underside of the dipper stick and connecting pin 17 may be operated to curl and uncurl the bucket in the conventional manner.

During pivotal movement of the dipper stick and/or the curling and uncurling of the bucket by means of the operation of the cylinder assembly interconnecting the dipper stick and connecting pin 17, the principal function of spacer links 22 and 23 is to maintain connecting pins 13 and 21 in the opposed recesses of the bucket mounting brackets.

In lieu of a pair of rigid spacer links 22 and 23, each spacer link may consist of a first link segment rigidly mounted on connecting pin 13 and projecting substantially radially therefrom, a second link segment rigidly connected to an end of connecting pin 21 and projecting radially therefrom and a pin pivotally connecting overlapping, free ends of such link segments. As connecting pins 13 and 21 are displaced toward each other, such link segments will be caused to angularly displace toward each other to retracted, inoperative positions, and when such connecting pins are displaced apart, the link segments will be caused to angularly displace apart to extended, operative positions. Each of such set of link segments is provided with means for releasably latching the link segments together when such segments are in their extended, operative positions.

In an arrangement equipped with such angularly displaceable link segments, with the bucket positioned on the ground and the link segments disposed in their retracted, inoperative positions, such bucket may be coupled to the dipper stick first by manipulating the dipper stick to insert the ends of connecting pin 13 in the forwardly disposed recesses of the mounting brackets on the implement, and then by operating the actuating assembly to cause the link segments to angularly displace apart and correspondingly cause the end portions of connecting pin 21 to be inserted into the rearwardly disposed recesses of the mounting brackets. When the connecting pins 13 and 21 are thus positioned in the recesses of the mounting brackets, the latch mechanisms are actuated to secure the link segments in their extended, operative positions and, correspondingly, connecting pins 13 and 21 in the opposed recesses of the mounting brackets of the implement, firmly coupling the implement to the dipper stick.

In machines and buckets of different manufacturers and also in different machine or bucket models of a single manufacturer, the widths of the dipper sticks, the diameters of the connecting pins, the transverse spacing of the implement mounting brackets, the spacing between the opposed recesses of each of a set of mounting brackets and the configurations of such recesses may vary thus rendering ineffective single sizes of coupling assemblies as described. To accommodate such variances and thus provide for the effective use of single sizes of the coupling assemblies as described, an adapter assembly 40 as shown in FIGS. 3 and 4 and an adapter assembly 60 as shown in FIGS. 6 and 7 may be used.

Figure 3:
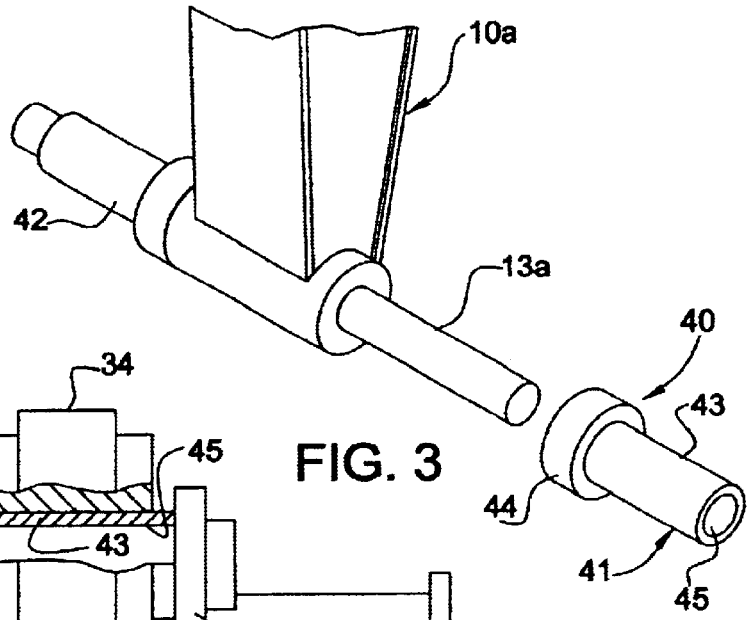
FIG. 3 is a perspective view of the free end of the dipper stick shown in FIGS. 1 and 2, illustrating the use of a pair of bushings mountable on the connecting pin of the dipper stick, embodying the present invention.
Figure 4:
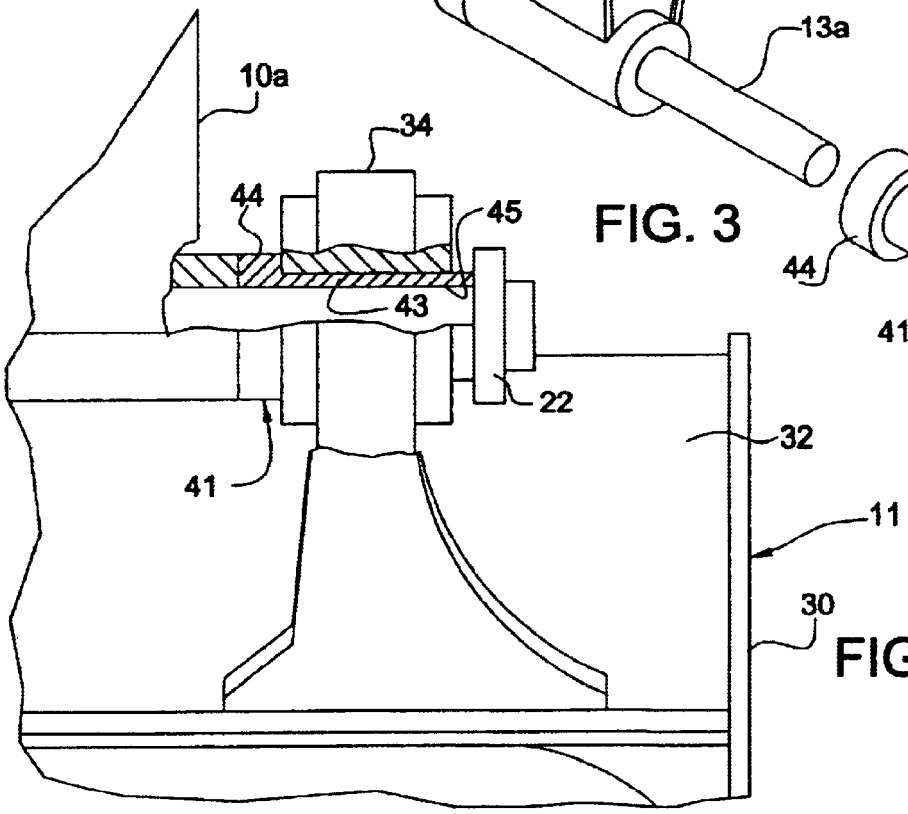
FIG. 4 is a front elevational view similar to the view shown in FIG. 2, illustrating the use of a bushing embodying the present invention and having portions thereof broken away.

Referring to FIGS. 3 and 4, there is illustrated a dipper stick 10*a* having a width less than the width of dipper stick 10 and a connecting pin 13*a* having a diameter less than connecting pin 13. To compensate for such dimensional variances and thus permit the coupling of bucket 11 to dipper stick 10*a*, a pair of bushings 41 and 42 is mounted on the end portions of connecting pin 13*a*. Bushing 41 is provided with a cylindrical shank portion 43 and a head or annular flange portion 44 having an axial bore 45 therethrough for receiving an end portion of connecting pin 13*a*. The shank portion of the bushing provides the end portion of the connecting pin with a sufficient diameter to permit the snug insertion of the ends of the connecting pin into the forwardly disposed set of recesses in the mounting brackets of the bucket, and the axial dimension of the head or angular flange portion of the bushing compensates for the narrower width of the dipper stick to provide for proper centering of the dipper stick relative to the mounting brackets of the bucket. Bushing 42 is mountable on the opposite end of connecting pin 13*a*, is constructed identical to bushing 41 and functions in the same manner to accommodate the insertion of its portion of the connecting pin in the associated recess of a mounting bracket and cooperate in centering the dipper stick relative to the mounting brackets of the bucket.

Referring to FIGS. 6 and 7, adapter assembly 50 includes a set of bushings 51 and 52 mountable on connecting pin 21 rigidly connected at its end portions to spacer links 22 and 23 and extending through the free ends of actuating links 18 and 19. The lengths of such bushings and their diameters may be varied to accommodate any actuating link construction, spacing of any mounting brackets and configurations of mounting bracket recesses in which such bushings mounted on the ends of connecting pin 21 may be inserted. As shown in FIG. 6, a set of washers 53 and 54 having inwardly facing, annular beveled surfaces may be interposed between the bushings and the actuating links, and a pair of sealing rings 55 and 56 may be interposed between the annular beveled surfaces of the washers and the actuating links.

To accommodate implements with mounting brackets spaced further apart than a selected standard set of brackets, bushings 51 may be formed with an outer cylindrical surface disposed eccentrically relative to the inner cylindrical surface thereof so that such bushings may be rotated about the axes thereof to vary the spacing between the connecting pins when such pins are in their furthest displacement within the opposed recesses of the mounting brackets to snuggly fit the connecting pins within the recesses without undo play between the connecting pins and the mounting brackets. Similarly, the shank portions of bushings 41 and 42 may be formed with outer cylindrical surfaces disposed eccentrically relative to the inner cylindrical surface of bore 45 to similarly permit such bushings to be rotated on an end portion of connecting pin 13*a* to vary the distances between the connecting pins when received in the opposed recesses of a mounting bracket.

It is contemplated that the components of an adapter assembly as described would be provided as a kit designed to accommodate a particular machine model or bucket model. Such assemblies would permit the use of a standard coupling attachment and an adapter kit, which may be used with such standard coupling attachment to accommodate dimensional variances in dipper sticks of machines and the mounting brackets of implements.

The connecting pins preferably are formed of hardened steel and are provided with sufficient tensile strength to carry various loads imposed during typical digging operations. The spacer links or the segments thereof may be formed of carbon steel castings or may be formed of steel plate. To prevent undo wear of pin engaging surfaces of rigid spacer links as shown in FIG. 1, harden steel inserts may be provided as shown in FIG. 1. In addition, in lieu of providing the forwardly disposed ends of rigid spacer links with abutment surfaces, they may be provided with downwardly opening recesses or forwardly and downwardly opening recesses for receiving and thus engaging the ends of a connecting pin. As previously described, latch mechanisms are provided with rigid spacer links to releasably secure such links to an engaging connecting pin, and also with spacer links comprising pivotally connected link segments for releasably securing such segments in their extended, operative positions.

It will be appreciated that the present invention provides a simple and easily installed assembly for modifying dipper sticks and implements of a variety of sizes and configurations to receive a similarly simple and effective assembly for detachably securing implements including buckets, grapple, rakes and the like to the dipper stick of a machine.

From the foregoing detailed description, it will be evident that there are a number of changes, adaptations and modifications of the present invention, which come within the province of those persons having ordinary skill in the art to which the aforementioned inventions pertain. However, it is intended that all such variations not departing from the spirit of the invention be considered as within the scope thereof as limited solely by the appended claims.

I claim:

1. An assembly mountable on a machine, including an implement provided with a pair of mounting brackets each having a pair of opposed pin receiving recesses, said implement is selected from a group of implements having varying sized and shaped recesses, a dipper stick operatively connectable to said machine for selective movements and having a first connecting pin rotatably mounted in an end thereof and receivable in one of said implement recesses of each bracket, a fluid actuated cylinder assembly having a cylinder member pivotally connectable to said dipper stick and a rod member provided with an operatively connected pin rotatable relative thereto and receivable in the other of said implement recesses of each bracket, and a pair of spacer links each disposed on a side of said dipper stick and spaced therefrom, and operable to selectively maintain said connecting pins in retracted, inoperative positions permitting said connecting pins to be maneuvered and inserted into or removed from said implement recesses, and in extended, operative positions within said implement recesses, detachably coupling said implement to said dipper stick, an adapter assembly comprising:

a pair of bushings each mountable on one of said connecting pins between one of said dipper stick and said operative connection of one of said connecting pins to said rod member, and one of said spacer links, each bushing selected from a group of bushings having varying configurations, said selected bushing having a configuration receivable within and conforming to one of said implement recesses for the selected implement.

2. An assembly accordingly to claim 1 wherein each of said bushings has a cylindrical exterior surface receivable within an implement recess having a curved surface.

3. An adapter according to claim 1 wherein each of said bushings has a length sufficient to receive a mounting bracket of said implement between said one of said dipper stick and said operative connection of one of said connecting pins to said rod member, and said spacer link.

4. An assembly according to claim 1 including a washer disposable between each of said bushings and said one of said dipper stick and said operative connection of one of said connecting pins and said rod member.

5. An assembly according to claim 4 wherein said washer includes an annular, beveled surface, and including an annular seal disposed between said beveled surface and said one of said dipper stick and said operative connection of one of said connecting pins and said rod member.

6. An assembly according to claim 1 wherein each of said bushings includes a cylindrical bore therethrough for receiving said connecting pin therethrough and a cylindrical exterior surface disposed eccentrically relative to said cylindrical bore, and wherein said bushing may be angularly displaced relative to the axis of said connecting pin to alter the spacing of the outer surfaces of said connecting pins to accommodate implement mounting brackets with different spacing between the opposed recesses thereof.

7. An assembly according to claim 1 wherein there is provided a first pair of said bushings each disposable between said dipper stick and one of said spacer links, and a second pair of said bushings each disposable between said operative connection of said one of said connecting pins and one of said spacer links.

8. An assembly according to claim 1 wherein each of said bushings includes a head section and integral shank section.

9. An assembly according to claim 8 wherein each of said shank sections has a cylindrical exterior surface receivable within an implement recess having a curved surface.

10. An assembly according to claim 8 wherein each of said shank sections has a length sufficient to receive a mounting bracket of said implement between its head section and its respective spacer link.

11. An assembly according to claim 8 wherein each of said bushings includes a cylindrical bore therethrough for receiving its respective connecting pin therethrough and a shank section having a cylindrical exterior surface disposed eccentrically relative to said cylindrical bore, and wherein each of said bushings may be angularly displaced relative to the axis of its respective connecting pin to vary the spacing between the outer surfaces of said connecting pins to accommodate implement mounting brackets with different spacing between the opposed recesses thereof.

12. An assembly mountable on a machine, including an implement provided with a pair of mounting brackets each having a pair of opposed pin receiving recesses, a dipper stick operatively connectable to said machine for selective movements and having a first connecting pin rotatably mounted in an end thereof and receivable in one of said implement recesses of each bracket, a fluid actuated cylinder assembly having a cylinder member pivotally connectable to said dipper stick and a rod member provided with an operatively connected pin rotatable relative thereto and receivable in the other of said implement recesses of each bracket, and a pair of spacer links each disposed on a side of said dipper stick and spaced therefrom, and operable to selectively maintain said connecting pins in retracted, inoperative positions permitting said connecting pins to be maneuvered and inserted into or removed from said implement recesses, and in extended, operative positions within said implement recesses, detachably coupling said implement to said dipper stick, an adapter assembly comprising:

a pair of bushings each mountable on one of said connecting pins between one of said dipper stick and said operative connection of one of said connecting pins to said rod member, and one of said spacer links, selected from a group of bushings having varying configurations, having a configuration receivable within and conforming to one of said implement recesses, and a washer disposable between each of said bushings and said one of said dipper stick and said operative connection of one of said connecting pins and said rod member.

13. An assembly according to claim 12 wherein said washer includes an annular, beveled surface, and including an annular seal disposed between said beveled surface and said one of said dipper stick and said operative connection of one of said connecting pins and said rod member.

14. An assembly mountable on a machine, including an implement provided with a pair of mounting brackets each having a pair of opposed pin receiving recesses, a dipper stick operatively connectable to said machine for selective movements and having a first connecting pin rotatably mounted in an end thereof and receivable in one of said implement recesses of each bracket, a fluid actuated cylinder assembly having a cylinder member pivotally connectable to said dipper stick and a rod member provided with an operatively connected pin rotatable relative thereto and receivable in the other of said implement recesses of each bracket, and a pair of spacer links each disposed on a side of said dipper stick and spaced therefrom, and operable to selectively maintain said connecting pins in retracted, inoperative positions permitting said connecting pins to be maneuvered and inserted into or removed from said implement recesses, and in extended, operative positions within said implement recesses, detachably coupling said implement to said dipper stick, an adapter assembly comprising:

a pair of bushings each mountable on one of said connecting pins between one of said dipper stick and said operative connection of one of said connecting pins to said rod member, and one of said spacer links, selected from a group of bushings having varying configurations, having a configuration receivable within and conforming to one of said implement recesses, wherein each of said bushings includes a cylindrical bore therethrough for receiving said connecting pin therethrough and a cylindrical exterior surface disposed eccentrically relative to said cylindrical bore, and wherein said bushing may be angularly displaced relative to the axis of said connecting pin to alter the spacing of the outer surfaces of said connecting pins to accommodate implement mounting brackets with different spacing between the opposed recesses thereof.

15. An assembly accordingly to claim 14 wherein each of said bushings has a cylindrical exterior surface receivable within an implement recess having a curved surface.

16. An adapter according to claim 14 wherein each of said bushings has a length sufficient to receive a mounting bracket of said implement between said one of said dipper stick and said operative connection of one of said connecting pins to said rod member, and said spacer link.

17. An assembly according to claim 14 including a washer disposable between each of said bushings and said one of said dipper stick and said operative connection of one of said connecting pins and said rod member.

18. An assembly according to claim 17 wherein said washer includes an annular, beveled surface, and including an annular seal disposed between said beveled surface and said one of said dipper stick and said operative connection of one of said connecting pins and said rod member.

19. An assembly according to claim 14 wherein each of said bushings includes a head section and integral shank section.

20. An assembly according to claim 19 wherein each of said shank sections has a length sufficient to receive a mounting bracket of said implement between its head section and its respective spacer link.

21. An assembly mountable on a machine, including an implement provided with a pair of mounting brackets each having a pair of opposed pin receiving recesses, a dipper stick operatively connectable to said machine for selective movements and having a first connecting pin rotatably mounted in an end thereof and receivable in one of said implement recesses of each bracket, a fluid actuated cylinder assembly having a cylinder member pivotally connectable to said dipper stick and a rod member provided with an operatively connected pin rotatable relative thereto and receivable in the other of said implement recesses of each bracket, and a pair of spacer links each disposed on a side of said dipper stick and spaced therefrom, and operable to selectively maintain said connecting pins in retracted, inoperative positions permitting said connecting pins to be maneuvered and inserted into or removed from said implement recesses, and in extended, operative positions within said implement recesses, detachably coupling said implement to said dipper stick, an adapter assembly comprising:

a pair of bushings each mountable on one of said connecting pins between one of said dipper stick and said operative connection of one of said connecting pins to said rod member, and one of said spacer links, selected from a group of bushings having varying configurations, having a configuration receivable within and conforming to one of said implement recesses, wherein each of said bushings includes a head section and integral shank section, each of said shank sections having a cylindrical exterior surface receivable within an implement recess having a curved surface.

22. An assembly mountable on a machine, including an implement provided with a pair of mounting brackets each having a pair of opposed pin receiving recesses, a dipper stick operatively connectable to said machine for selective movements and having a first connecting pin rotatably mounted in an end thereof and receivable in one of said implement recesses of each bracket, a fluid actuated cylinder assembly having a cylinder member pivotally connectable to said dipper stick and a rod member provided with an operatively connected pin rotatable relative thereto and receivable in the other of said implement recesses of each bracket, and a pair of spacer links each disposed on a side of said dipper stick and spaced therefrom, and operable to selectively maintain said connecting pins in retracted, inoperative positions permitting said connecting pins to be maneuvered and inserted into or removed from said implement recesses, and in extended, operative positions within said implement recesses, detachably coupling said implement to said dipper stick, an adapter assembly comprising:

a pair of bushings each mountable on one of said connecting pins between one of said dipper stick and said operative connection of one of said connecting pins to said rod member, and one of said spacer links, selected from a group of bushings having varying configurations, having a configuration receivable within and conforming to one of said implement recesses, wherein each of said bushings includes a head section and integral shank section and each of said bushings includes a cylindrical bore therethrough for receiving its respective connecting pin therethrough and a shank section having a cylindrical exterior surface disposed eccentrically relative to said cylindrical bore, and wherein each of said bushings may be angularly displaced relative to the axis of its respective connecting pin to vary the spacing between the outer surfaces of said connecting pins to accommodate implement mounting brackets with different spacing between the opposed recesses thereof.

* * * * *